US009320314B2

(12) United States Patent
Zampieri et al.

(10) Patent No.: US 9,320,314 B2
(45) Date of Patent: Apr. 26, 2016

(54) SPORTS FOOTWEAR PROVIDED WITH AN ADJUSTABLE REAR SPOILER

(71) Applicant: Tecnica Group S.P.A., Giavera del Montello (IT)

(72) Inventors: Claudio Zampieri, Giavera del Montello (IT); Nicola Bonora, Giavera del Montello (IT); Paolo Bordin, Giavera del Montello (IT); Roberto Mattarollo, Giavera del Montello (IT)

(73) Assignee: Tecnica Group S.p.A., Giavera Del Montello (TV) (IT)

( * ) Notice: Subject to any disclaimer, the term of this patent is extended or adjusted under 35 U.S.C. 154(b) by 0 days.

(21) Appl. No.: 14/477,371

(22) Filed: Sep. 4, 2014

(65) Prior Publication Data

US 2015/0068067 A1 Mar. 12, 2015

(30) Foreign Application Priority Data

Sep. 6, 2013 (IT) ..... TO20130138 U

(51) Int. Cl.
*A43B 5/04* (2006.01)
*A43B 5/16* (2006.01)

(52) U.S. Cl.
CPC ..... *A43B 5/0433* (2013.01); *A43B 5/0431* (2013.01); *A43B 5/1691* (2013.01)

(58) Field of Classification Search
CPC ..... A43B 5/04; A43B 5/048; A43B 5/0429; A43B 5/0431; A43B 5/0433; A43B 5/0049; A43B 5/0456; A43B 5/1691
USPC ..... 36/117, 117.1; 24/69 R, 68 SK, 69 SK, 24/70 SK, 71 SK
See application file for complete search history.

(56) References Cited

U.S. PATENT DOCUMENTS

| | | | | | |
|---|---|---|---|---|---|
| 4,653,204 | A * | 3/1987 | Morell | A43C 11/16 | 24/68 SK |
| 4,718,180 | A * | 1/1988 | Hilgarth | A43B 5/0433 | 24/68 SK |
| 4,748,726 | A * | 6/1988 | Schoch | A43C 11/16 | 24/68 B |
| 4,754,560 | A * | 7/1988 | Nerrinck | A43C 11/16 | 24/68 SK |
| 5,067,258 | A * | 11/1991 | Martignago | A43B 5/0456 | 36/118.7 |
| 5,524,366 | A * | 6/1996 | Caeran | A43B 5/0456 | 36/118.3 |
| 6,631,919 | B1 * | 10/2003 | West et al. | 280/633 | |
| 2003/0204938 | A1 * | 11/2003 | Hammerslag | 24/68 SK | |

* cited by examiner

*Primary Examiner* — Robert J Hicks
*Assistant Examiner* — Jillian K Pierorazio
(74) *Attorney, Agent, or Firm* — Howson & Howson LLP

(57) ABSTRACT

Sports footwear, in particular to a ski boot, having an adjustable rear spoiler is provided. The spoiler is connected by respective connecting elements to the side elements attached to or integral with the cuff of the sports footwear and the distance of the connecting elements from each other can be adjusted by acting on a single, common adjusting device. Thus, adjustment of the volume inside the cuff, which receives the ankle and the lower portion of the calf of a user, takes place in an extremely simple and quick manner and without the risk of asymmetries in the adjustment.

14 Claims, 3 Drawing Sheets

SPORTS FOOTWEAR PROVIDED WITH AN ADJUSTABLE REAR SPOILER

BACKGROUND

The present invention relates to sports footwear provided with an adjustable rear spoiler. In particular, the present invention relates to a ski boot equipped with an adjustable rear spoiler.

Ski boots are well-known and widely spread. In general, said ski boots comprise an inner shoe made of a substantially soft and flexible material and an outer shell made of a substantially rigid material.

The outer shell typically comprises a plurality of elements articulated to each other, including in particular a cuff, intended to surround and wrap the user's ankle and the lower part of the user's calf and articulated to the lower portion of the shell accommodating the user's foot. The outer shell of the ski boot is usually provided with a plurality of fastening elements, such as hooks, buckles or the like, which allow to close the shell on the user's foot and which can assume a plurality of different positions, so that the user can adjust said fastening elements according to his/her own morphology, so as to obtain the maximum possible comfort.

However, considering the differences in the morphology of the different users, the possibility to adjust the fastening elements is often insufficient for adapting the ski boot to the morphology of each single user. More particularly, for the same size of boot there may be users having very thin calves or, vice versa, users having more voluminous calves. In this case, the possibility to adjust the fastening elements provided on the cuff of the ski boot among a plurality of different positions may not be sufficient to ensure the desired comfort to the user. In other words, users with very thin calves may feel not sufficiently supported and at ease even when the fastening elements provided on the cuff are in their most tightened position or—vice versa—users with very voluminous calves may feel constrained and uncomfortable even when the fastening elements provided on the cuff are in their most loosened position.

In order to overcome this drawback, ski boots have been made provided with a so-called "spoiler"—that is, a separate rear plate provided at the rear portion of the cuff of the ski boot shell—and, thanks to the presence of the spoiler, a further possibility of adjustment of the degree of closure of the ski boot at the calves of the user has been introduced.

Also, with reference to FIG. 1, which shows an example of a ski boot provided with a spoiler of the known type, a ski boot 100 generally comprises a substantially rigid outer shell 110 formed from a plurality of mutually articulated elements, including a cuff 120 intended to surround and wrap the user's ankle and the lower part of the user's calf. For better adapting the cuff 120 to the morphology of the user, and specifically to the morphology of his/her calves, it is possible to provide a spoiler 130, arranged at the rear portion of the cuff 120, in a substantially central position, between respective side elements 120*a*, 120*b* of the cuff itself.

The spoiler 130 is connected to the side elements 120*a*, 120*b* of the cuff 120 through connecting elements 132*a*, 132*b*, which can be adjusted so as to approach/move away the respective side element 120*a*, 120*b* with respect to the middle longitudinal line M of the cuff itself, approaching the side elements 120*a*, 120*b* to each other or moving them away from each other.

It is evident that approaching the side elements 120*a*, 120*b* of the cuff 120 to each other makes it possible to reduce the space inside the cuff itself (adapting it to users with very thin calves), while moving the side elements 120*a*, 120*b* of the cuff 120 away from each other makes it possible to increase the space inside the cuff itself (adapting it to users with very voluminous calves).

However, the solution described above and shown in FIG. 1, although it provides for a further possibility of adjustment of the ski boot at the user's calf, is not free from drawbacks. First of all, in order to adjust the position of the side elements of the cuff of the ski boot it is necessary to act separately on two different connecting elements—one for each side—which makes the adjustment operation complex. This disadvantage can be seriously felt, for instance, in stores of renting of sports equipment in ski resorts, where—especially during the high season—the speed with which customers are served is essential.

Furthermore, having two different connecting elements that can be adjusted independently from each other, can lead to an incorrect adjustment and, in particular, to a non-symmetrical adjustment of the cuff with respect to the ankle and calf of the user, which may be disturbing during the use of the ski boot.

Although it has been hitherto made reference to the particular case of ski boots, the above-described drawbacks can also occur in the case of other types of sports footwear having a substantially rigid shell comprising a cuff that surrounds and wraps the user's ankle and the lower part of the user's calf, such as in-line roller skates.

SUMMARY

The main object of the present invention is to overcome the limitations of the prior art, by providing a sports footwear provided with an adjustable rear spoiler that is free from the drawbacks mentioned above. This and other objects are achieved by a sports footwear as claimed in the appended claims.

Thanks to the fact that the spoiler of the sports footwear according to the invention is provided with a single adjustment device acting—preferably simultaneously—on both the connecting elements for the connection to respective side elements attached to the cuff of the footwear or integral with it, the adjustment takes place in a simpler and quicker manner than in footwear of the prior art.

Moreover, always thanks to the fact that the spoiler of the sports footwear according to the invention is provided with a single adjustment device acting—preferably simultaneously—on both the connecting elements for the connection to respective side elements attached to the cuff of the footwear or integral with it, the side elements can be brought closer to the middle longitudinal line of the cuff or moved away from it by the same distance, which ensures a symmetrical adjustment of the cuff.

BRIEF DESCRIPTION OF THE DRAWINGS

Features and advantages of the invention will be apparent from the following description of a preferred and non-limiting embodiment thereof, illustrated with reference to the accompanying drawings, in which.

It is to be noted that in the present context a "front view" of the spoiler is a view seen from outside the sports footwear, while a "rear view" of the spoiler is a view seen from inside the sports footwear.

DETAILED DESCRIPTION

Figure 1:
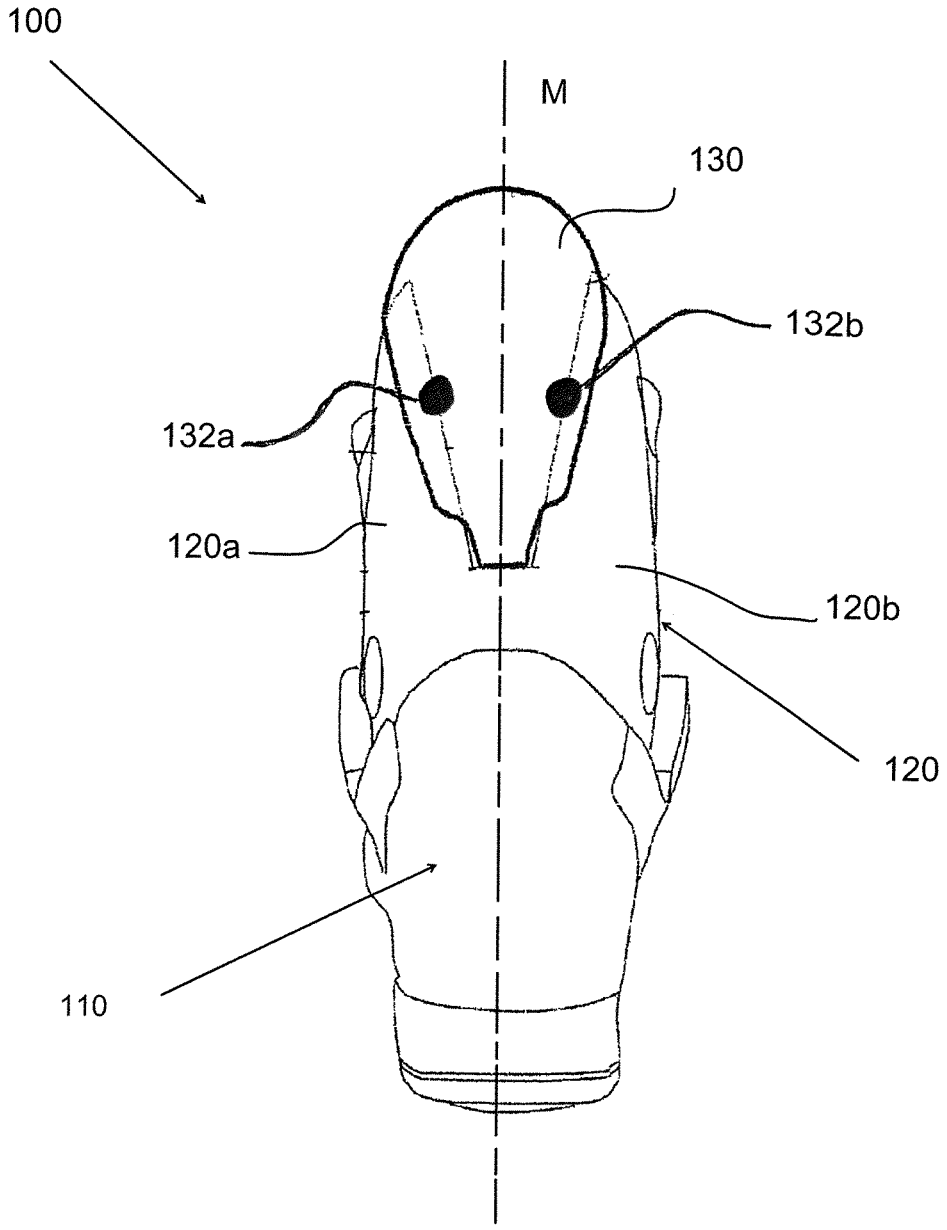
FIG. 1 (PRIOR ART)
FIG. 1 is a rear view of a ski boot equipped with an adjustable spoiler according to prior art.
Figure 2A:
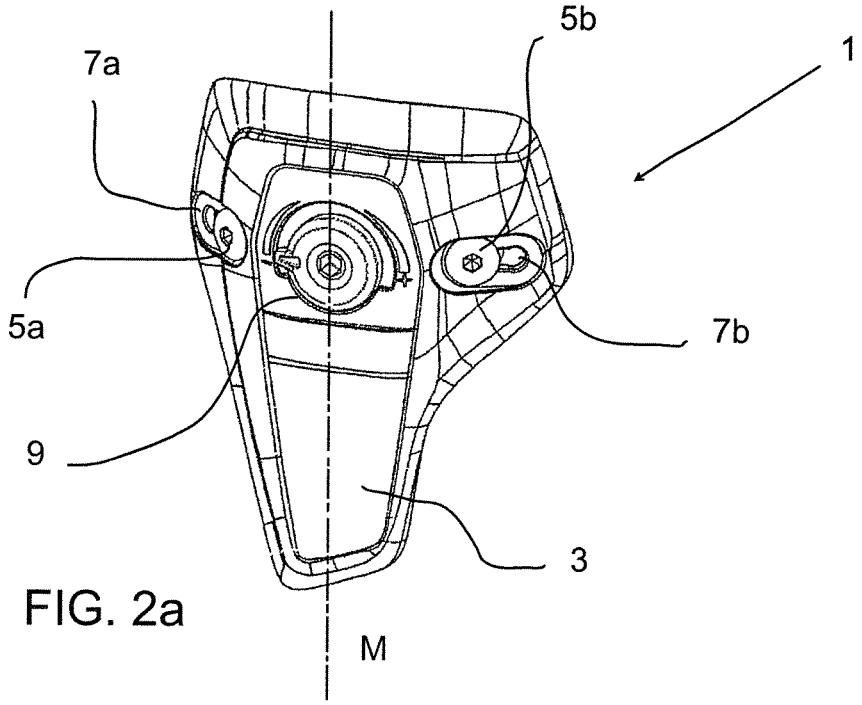
FIG. 2*a* is a front view of a spoiler usable in a sports footwear according to the invention, shown in a first configuration.
Figure 2B:
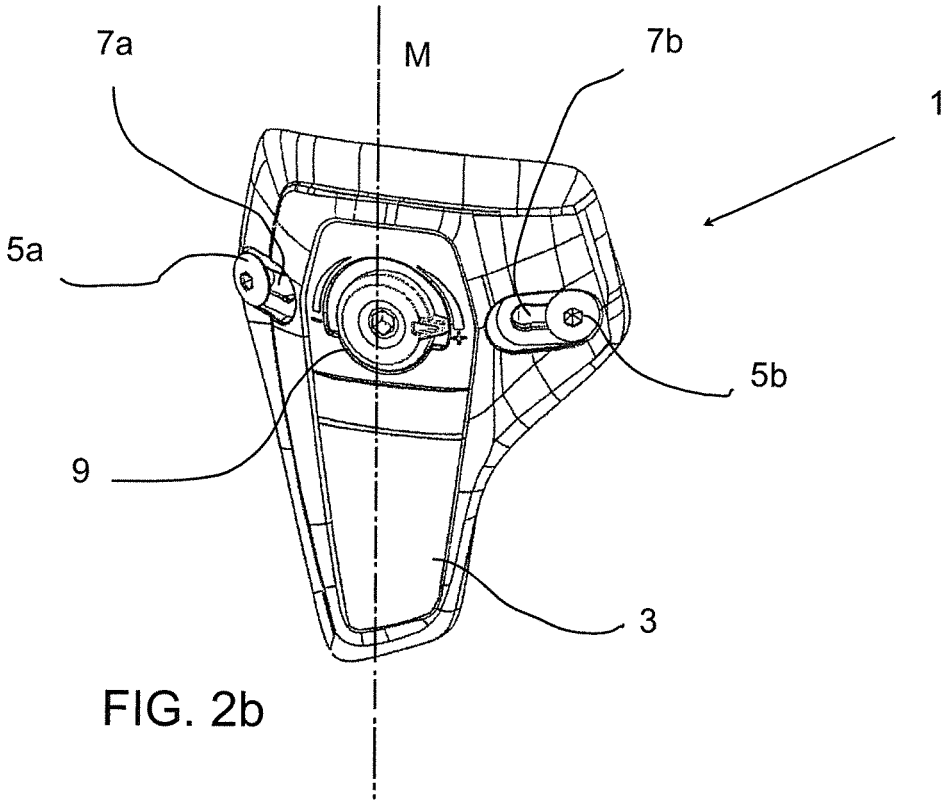
FIG. 2*b* is a front view of the spoiler of FIG. 2*a*, shown in a second configuration.
Figure 2C:
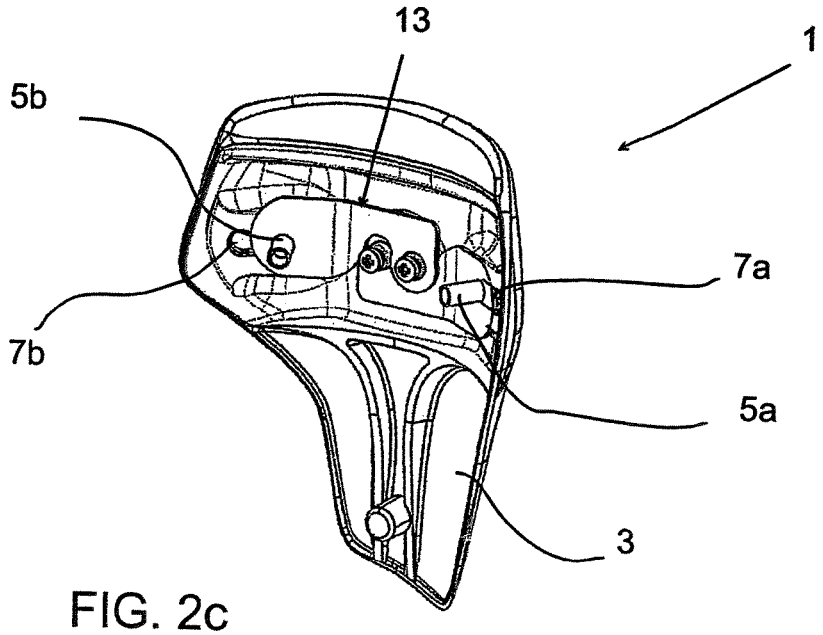
FIG. 2*c* is a rear view of the spoiler of FIG. 2*a*.

With reference to FIGS. 2*a*-2*c*, a spoiler 1 for a sports footwear, more particularly for a ski boot, is shown. As mentioned above, the spoiler 1 is a plate made of a substantially rigid material, generally suitable for being positioned between the lateral sides of the cuff of the ski boot shell, at a rear and substantially central position of said cuff.

In the embodiment shown in the Figures, the spoiler 1 comprises a body 3 having substantially the shape of an inverted trapezoid, which has its smaller base facing downwards and widens upwards. This shape is particularly fitted to the shape of the user's leg, which widens going up from the ankle towards the calf. However, it is not to be intended as limiting, and other shapes can also be used.

In the shown preferred embodiment, the spoiler 1 comprises a pair of connecting elements 5*a*, 5*b* for the connection to the side elements of the ski boot cuff, one for each of the side elements of the cuff. In the shown embodiment, the connecting elements are simple connecting pins 5*a*, 5*b*, comprising a head that is secured to the body 3 of the spoiler 1 and a stem that is intended to pass through said body 3 of the the spoiler and through the corresponding side element of the ski boot cuff and to be riveted or fixed in any other way to the side element, thus connecting each of the side elements of the cuff to the spoiler 1.

In an alternative embodiment of the invention, a pair of dedicated side elements can be provided at the sides of the body 3 of the spoiler 1, the dedicated side elements being in turn connected to the cuff.

In order to allow the adjustment of the position of the side elements of the cuff—and consequently of the volume defined within the cuff itself—the connecting pins 5*a*, 5*b* are not fixedly connected to the body 3 of the spoiler 1; on the contrary, the heads of the connecting pins are housed in respective slots 7*a*, 7*b* formed in the body 3 of the spoiler 1 and can translate inside them.

Specifically, the slots 7*a*, 7*b* extend in a direction that is substantially perpendicular to the middle longitudinal line M of the spoiler 1 or—more generally—in a direction having a component that is substantially perpendicular to said middle longitudinal line M.

Due to the presence of the slots 7*a*, 7*b*, the connecting pins 5*a*, 5*b* can move from a position closer to the middle longitudinal line M (FIGS. 2*a* and 2*c*) to a position farther from the middle longitudinal line M (FIG. 2*b*). Correspondingly, the side elements of the cuff connected to the connecting pins will be in a position closer to each other (thus defining a smaller volume inside the cuff, suitable for users with particularly thin calves) or in a position farther from each other (thus defining a greater volume inside the cuff, suitable for users with particularly voluminous calves).

According to the invention, the spoiler 1 also comprises a single adjusting device 9 which is able to act on both connecting pins 5*a*, 5*b* to drive their translation within the respective slots 7*a*, 7*b*, and therefore to make them move closer to the middle longitudinal line M or away from it. For this purpose, the spoiler 1 includes respective linking means 13—preferably mechanical linking means—connecting the adjusting device 9 respectively to the first and second connecting pin 5*a*, 5*b*.

According to the preferred embodiment of the invention, the adjusting device 9 acts simultaneously on both connecting pins 5*a*, 5*b*: due to the presence of the adjustment device 9 and of the linking means 13, with a single operation it is thus possible to adjust the position of both the connecting pins 5*a*, 5*b*.

Furthermore, the connecting pins 5*a*, 5*b*-being controlled by a single adjusting device—will be always adjusted together and both in the same manner (i.e., they will always be at the same distance from the middle longitudinal line M), which will allow to avoid asymmetries in the adjustment of the ski boot cuff.

In an alternative embodiment of the invention, it is however possible to provide that the adjusting device 9 can act—not only simultaneously on both connecting pins 5*a*, 5*b*—but also selectively only on one or the other of the connecting pins.

Figure 3:
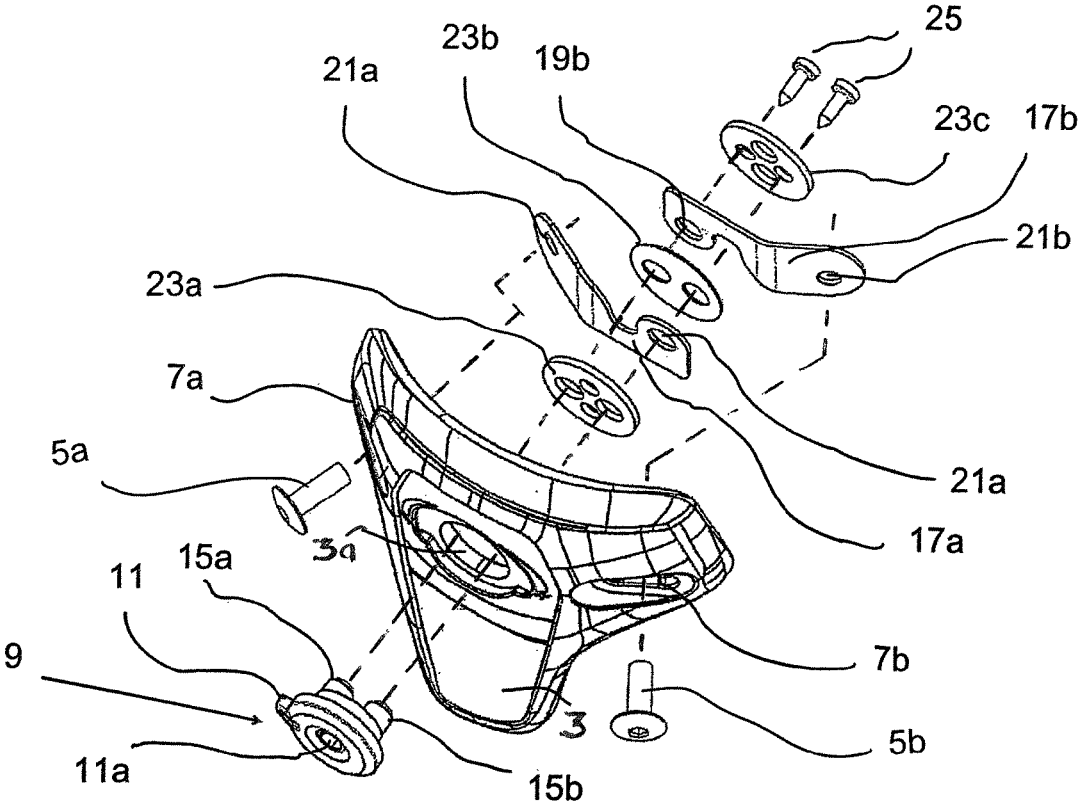
FIG. 3 is an exploded perspective view of the spoiler of FIG. 2*a*.

The structure of the adjusting device 9 and of the mechanical linking means 13 associated thereto according to the preferred, non-limiting embodiment of the spoiler 1 of the invention shown in FIGS. 2*a*-2*c* can be seen in FIG. 3, showing an exploded perspective view of spoiler 1. The adjusting device 9 comprises a rotatable knob 11 housed in a corresponding seat 3*a* formed in the body 3 of the spoiler 1. Advantageously, on its face which in use is accessible from the outside of the ski boot, the knob 11 is provided with a seat 11*a* suitable to receive an adequate tool, such as an Allen wrench, for turning the knob 11 in its seat 3*a*. On the face opposite to the seat 11*a*, the knob 11 is provided with a pair of plugs 15*a*, 15*b*, preferably hollow and internally threaded, arranged in an eccentric position with respect to the center of rotation of the knob 11.

A first of the plugs 15*a* passes through a through-hole 19*a* suitably formed in a first plate 17*a*, which also includes a second through-hole 21*a* for the passage of a first connecting pin 5*a* for the connection to a side element of the cuff. Similarly, the second of the plugs 15*b* passes through a through-hole 19*b* suitably formed in a second plate 17*b*, which also includes a second through-hole 21*b* for the passage of the second connecting pin 5*b* for the connection to the other side element of the cuff.

As clearly visible from FIG. 3, the plates 17*a*, 17*b* are shaped in such a way that the first plug 15*a*, which is connected to the first plate 17*a*, is not engaged with the second plate 17*b* and, conversely, the second plug 15*b*, which is connected to the second plate 17*b*, is not engaged with the first plate 17*a*. Therefore, the plates 17*a*, 17*b* bind the connecting pins 5*a*, 5*b* to the knob 11 of the adjusting device 9 through a rigid mechanical connection.

The plugs 15*a*, 15*b* are retained within the through-holes 19*a*, 19*b* of the respective plates 17*a*, 17*b* by means of caps 25, preferably provided with threaded stems, which are inserted, preferably screwed, inside the plugs 15*a*, 15*b*. Gaskets 23*a*, 23*b*, 23*c* are provided, respectively, between the knob 11 and the first plate 17*a*, between the two plates 17*a*, 17*b* and between the second plate 17*b* and the caps 25.

As the plugs 15*a*, 15*b* are arranged in an eccentric position with respect to the center of rotation of the knob 11, it will be evident that the rotation of the knob 11 and the consequent displacement of both plugs 15*a*, 15*b* will result in a variation of the position of both plates 17*a*, 17*b* mounted on said plugs and, specifically, in a variation of the distance of the through-holes 21*a*, 21*b*, provided in said plates for the passage of the connecting pins 5*a*, 5*b*, from the middle longitudinal line M of the spoiler 1.

Therefore, through a simple rotation of the knob 11 of the adjusting device 9, it will be possible to obtain the simultaneous translation of both the connecting pins 5*a*, 5*b* within the respective slots 7*a*, 7*b*, moving them closer to the middle longitudinal line M or away from it, or, in other words, bringing them closer to each other or farther from each other.

It is evident that the structure of the adjusting device 9 and of the mechanical linking means 13 associated thereto described above is not intended in any way as limiting, and any structure or construction known to the person skilled on the art that allows to obtain the simultaneous displacement of both connecting pins 5*a*, 5*b* by using a single, common adjusting device 9 can be used.

For example, it would be possible to provide for a pair of telescopic elements, each connected to a respective connecting pin, wherein the elongation/shortening of the telescopic elements could be simultaneously controlled by a single adjusting device.

From the above description, it is evident that the invention allows to achieve the object set forth above, as it allows a quick and accurate adjustment of the spoiler of a sports footwear. It is also evident that the above description has been provided purely by way of example and that several variations and modifications which are evident to the person skilled in the art are possible and they still fall under the scope of protection of the invention, as defined by the appended claims.

In particular, although in the given description explicit reference has been made to ski boots, the invention may be advantageously applied also to other types of sports footwear provided with a cuff that surrounds and wraps, at least partially, the calf of the user, such as for example skate boots.

The invention claimed is:

1. A sports footwear comprising a cuff intended to surround and wrap, at least partially, the calf of a user, the footwear further comprising a spoiler adapted to be positioned between a pair of side elements attached to or integral with the cuff and connected to the side elements by means of respective connecting elements, wherein the distance of the connecting elements from each other can be varied and wherein the spoiler also comprises a single adjusting device, the adjusting device being connected to both connecting elements by means of respective linking means, the adjusting device comprising a knob housed in a corresponding seat provided in a body of the spoiler, wherein the knob is provided with a pair of plugs arranged in an eccentric position with respect to a center of rotation of the knob, a first one of said plugs passing through a through-hole formed in a first plate, which plate also comprises a second through-hole for the passage of a first one of the connecting elements and the second one of said plugs passing through a through-hole formed in a second plate, which plate also comprises a second through-hole for the passage of the other one of the connecting elements.

2. The sports footwear of claim 1, wherein the adjusting device acts simultaneously on both connecting elements by means of the respective linking means.

3. The sports footwear of claim 1, wherein the adjusting device acts selectively on one and/or the other of the connecting elements by means of the respective linking means.

4. The sports footwear of claim 1, wherein the linking means connecting the adjusting device to the connecting elements are mechanical linking means.

5. The sports footwear of claim 1, wherein a middle longitudinal line is defined in the spoiler and the distance of the connecting elements from the middle longitudinal line can be varied by the adjusting device.

6. The sports footwear of claim 5, wherein the distance of both connecting elements from the middle longitudinal line can be varied simultaneously by means of the adjusting device.

7. The sports footwear of claim 6, wherein the distance of one of the connecting elements from the middle longitudinal line is equal, in magnitude, to the distance of the other of the connecting elements from the middle longitudinal line.

8. The sports footwear of claim 1, wherein the connecting elements are connecting pins, each of the connecting pins comprising a head which is secured to the body of the spoiler and a stem which passes through the body of the spoiler and through the corresponding side element of the cuff and is fixed on said side element of the cuff.

9. The sports footwear of claim 8, wherein the body of the spoiler comprises a pair of slots for respectively housing the heads of the connecting pins, the heads of the connecting pins being able to translate within the slots.

10. The sports footwear of claim 9, wherein a middle longitudinal line is defined in the spoiler and the slots extend in a direction that is substantially perpendicular to the middle longitudinal line of the spoiler.

11. The sports footwear of claim 1, wherein the knob is adapted to receive a suitable tool for rotating said knob in the seat.

12. The sports footwear of claim 1, wherein said sports footwear is a ski boot.

13. The sports footwear of claim 9, wherein a middle longitudinal line is defined in the spoiler and the slots extend in a direction having a component that is substantially perpendicular to the middle longitudinal line of the spoiler.

14. Sports footwear, comprising:

a cuff intended to surround and wrap, at least partially, a calf of a user; and a spoiler adapted to be positioned between a pair of side elements attached to or integral with the cuff and connected to the side elements with connecting elements;

wherein a distance of the connecting elements from each other is variable;

wherein the spoiler comprises a single adjusting device that is connected to the connecting elements by a linkage including first and second plates;

wherein the adjusting device includes a knob housed in a corresponding seat provided in a body of the spoiler;

wherein the knob is provided with a pair of plugs arranged in an eccentric position with respect to a center of rotation of the knob, a first one of said plugs passing through a through-hole formed in the first plate, which plate also comprises a second through-hole for the passage of a first one of the connecting elements, and the second one of said plugs passing through a through-hole formed in the second plate, which plate also comprises a second through-hole for the passage of a second one of the connecting elements.

* * * * *